US005548928A

United States Patent [19]

Chen

[11] Patent Number: 5,548,928

[45] Date of Patent: Aug. 27, 1996

[54] DOOR STRUCTURE

[76] Inventor: Min-chi Chen, No. 143-2, Sec. 1, Tungshan Rd., Taichung, Taiwan

[21] Appl. No.: 568,803

[22] Filed: Dec. 7, 1995

[51] Int. Cl.[6] ..... E06B 3/34

[52] U.S. Cl. ..... 49/381; 16/386; 49/399; 49/501

[58] Field of Search ..... 49/381, 501, 399, 49/398; 16/265, 386, 387

[56] References Cited

U.S. PATENT DOCUMENTS

| | | | |
|---|---|---|---|
| 3,448,486 | 6/1969 | Wright | 16/386 X |
| 3,458,955 | 8/1969 | Brooks | 49/399 X |
| 3,889,422 | 6/1975 | Nielsen | 49/501 |
| 3,949,526 | 4/1976 | Sherlock et al. | 49/501 |
| 4,542,558 | 9/1985 | Brockhaus | 16/386 X |
| 4,555,869 | 12/1985 | Kenkel | 49/501 X |
| 5,361,552 | 11/1994 | Fulford | 49/501 X |

*Primary Examiner*—Philip C. Kannan
*Attorney, Agent, or Firm*—Sixbey, Friedman, Leedom & Ferguson, P.C.; Stuart J. Friedman

[57] ABSTRACT

A door structure includes at least one hinge member having a first leaf fixedly mounted on one side plate of a mounting frame, and a second leaf pivotally engaged with the first leaf. A panel module includes at least two vertical side panels on one of which the second leaf is fixedly mounted. At least two horizontal side panels are each fixedly mounted between the two vertical side panels. At least two horizontal retaining members each include a first outer snapping portion mounted on one of the two horizontal side panels and a first inner snapping portion. At least two vertical retaining members each include a second outer snapping portion mounted on one of the two vertical side panels and a second inner snapping portion. At least two central panels are each fitted in the two first inner snapping portions, and are each fitted in the two second inner snapping portions. At least one reinforced beam is fixedly mounted between the two holding members and is rested between the two central panels.

3 Claims, 9 Drawing Sheets

DOOR STRUCTURE

FIELD OF THE INVENTION

The present invention relates to a door structure.

BACKGROUND OF THE INVENTION

A conventional door structure is shown in FIG. 9, however, there still remain shortcomings therein.

There will be a complete illustration in the detailed description of the preferred embodiments, concerning the conventional door structure.

The present invention has arisen to mitigate and/or obviate disadvantages of the conventional door structure.

SUMMARY OF THE INVENTION

The primary objective of the present invention is to provide a stable and reinforced door structure.

In accordance with one aspect of the present invention, there is provided a door structure comprising an inverted U-shaped mounting frame having two side plates. At least one hinge member includes a first leaf fixedly mounted on one of the two side plates, and a second leaf pivotally engaged with the first leaf.

A panel module is pivotally mounted in the mounting frame and includes at least two vertical side panels on one of which the second leaf is fixedly mounted. At least two horizontal side panels are each fixedly mounted between the two vertical side panels and each include a partition transversely formed in an innerside thereof and defining a chamber in two distal ends thereof.

At least two pairs of coupling members are each received in the chamber of an associated distal end of one of the two horizontal side panels and are each fixedly engaged with an associated vertical side panel.

At least two horizontal retaining members each include a substantially U-shaped first outer snapping portion mounted on a corresponding one of the two horizontal side panels and a substantially U-shaped first inner snapping portion. At least two vertical retaining members each include a substantially U-shaped second outer snapping portion mounted on a corresponding one of the two vertical side panels and a substantially U-shaped second inner snapping portion.

At least two vertical holding members are each fitted in a corresponding one of the two second inner snapping portions.

At least two central panels are each located between the two horizontal retaining members and fitted in the two first inner snapping portions, and are each located between the two vertical retaining members and fitted in the two second inner snapping portions. At least one horizontal reinforced beam is fixedly mounted between the two holding members and is rested between the two central panels.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 9:
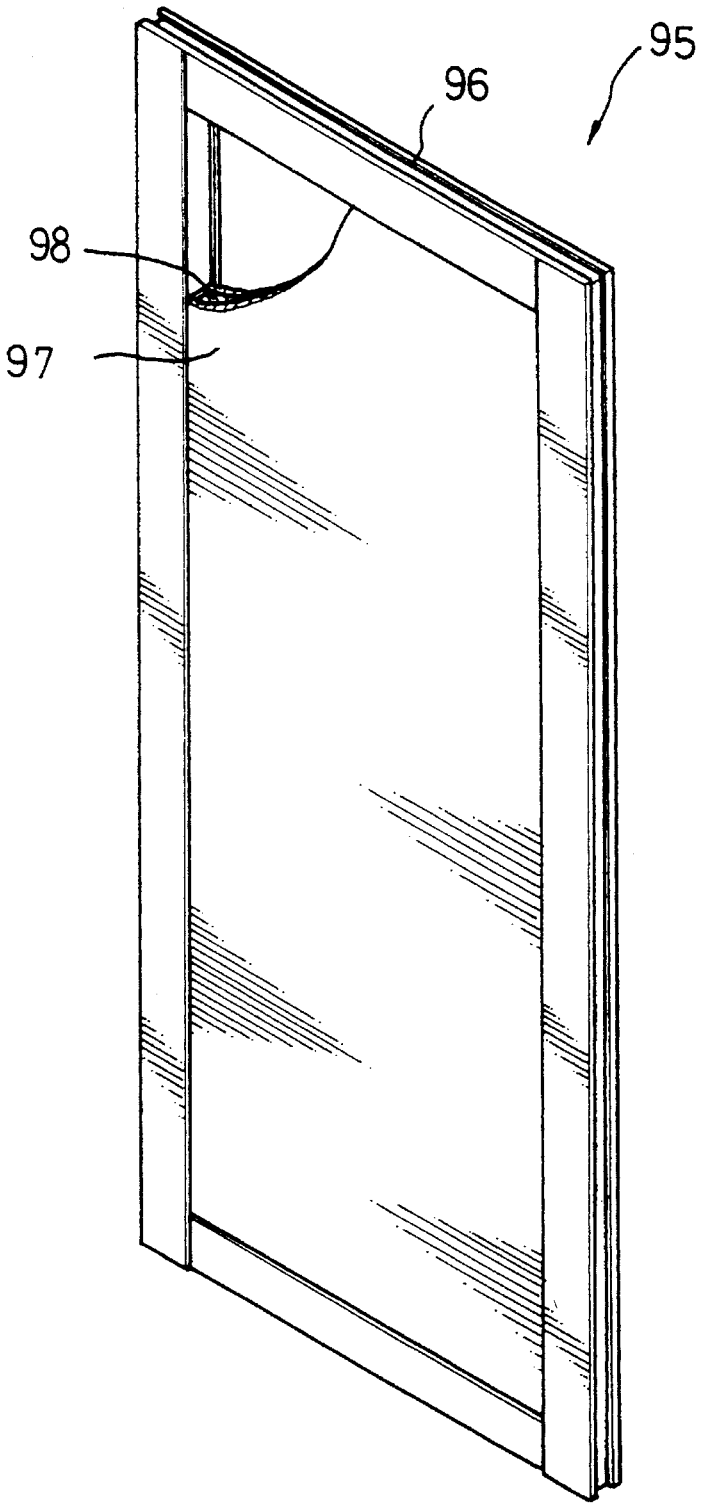
FIG. 9 PRIOR ART
FIG. 9 is a perspective view of a door structure in accordance with the prior art.

For a better understanding of features and benefits of the present invention, reference is made to FIG. 9, illustrating a conventional door structure in accordance with the prior art. A conventional door structure 95 in accordance with the prior art comprises a door frame 96, two panels 97 each mounted in the door frame 96, and a buffer 98 mounted between the two panels 97. However, by such an arrangement, the door structure 95 does not have any reinforced member mounted therein for supporting the two panels 97, so easily causing a deformation of the two panels 97 when being subjected to a great impact.

Figure 1:
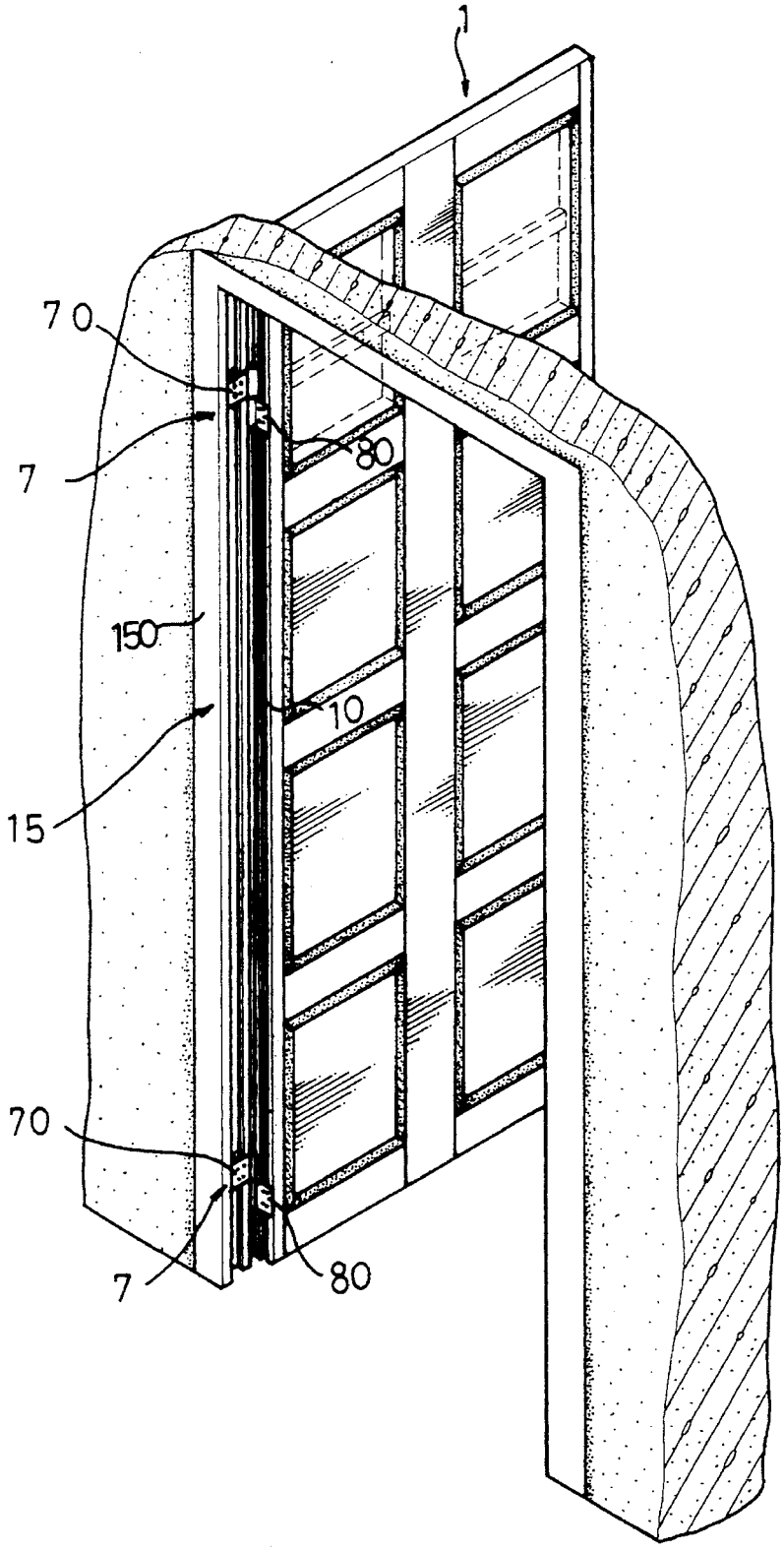
FIG. 1 is a perspective view of a door structure in accordance with the present invention.
Figure 2:
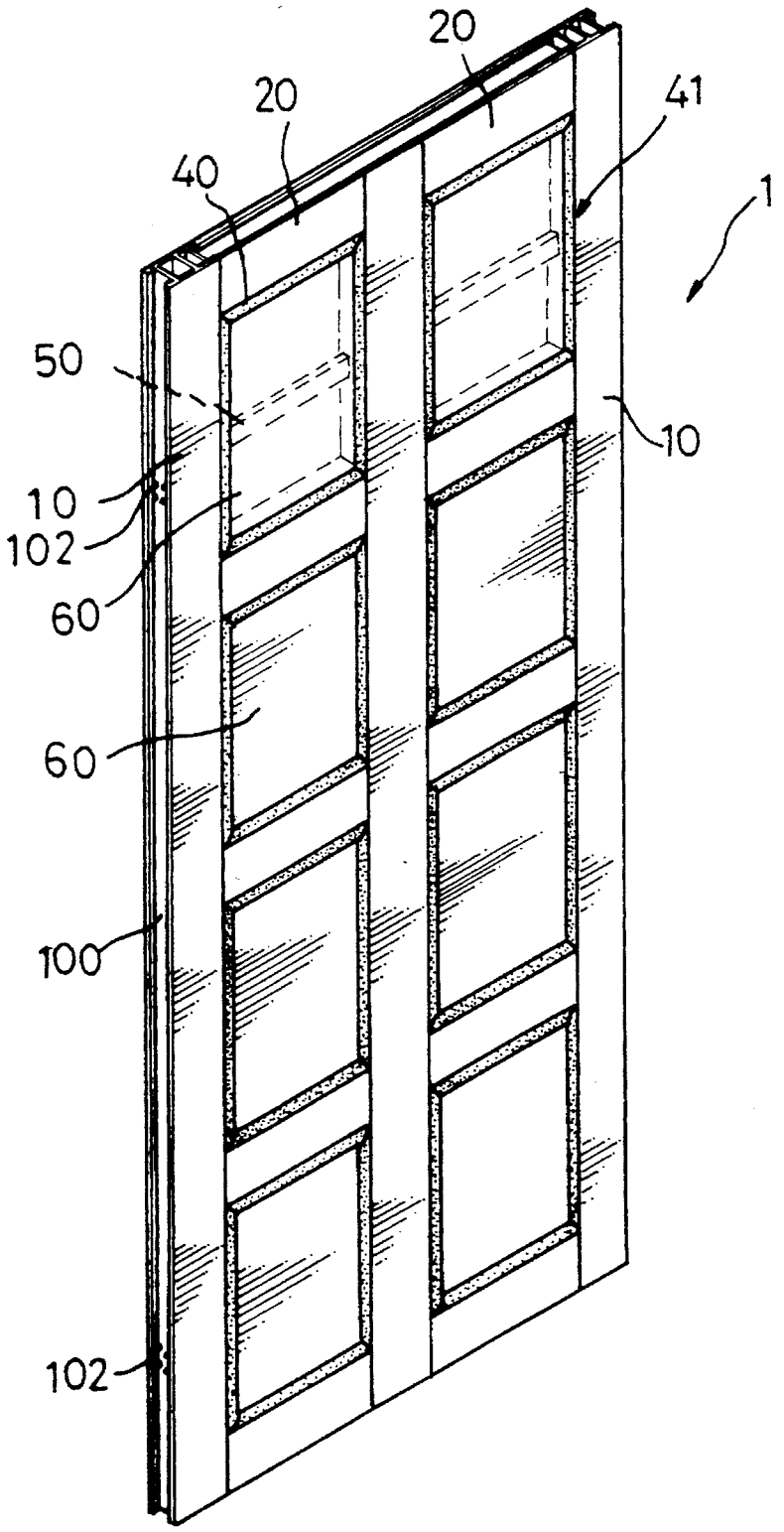
FIG. 2 is a perspective view of a panel module in accordance with the present invention.

Referring to FIGS. 1–8 and initially to FIGS. 1 and 2, a door structure in accordance with the present invention comprises a substantially inverted U-shaped mounting frame 15 having two side plates 150. Two hinge members 7 each include a first leaf 70 fixedly mounted on one of the two side plates 150, and a second leaf 80 pivotally engaged with the first leaf 70. A panel module 1 is pivotally mounted in the mounting frame 15.

The panel module 1 comprises a plurality of parallel vertical side panels 10 and a plurality of horizontal parallel side panels 20 securely connected and arranged in a perpendicular manner with each other as shown in FIG. 2. The second leaf 80 of each of the hinge members 7 is fixedly mounted on one of the vertical side panels 10.

Figure 3:
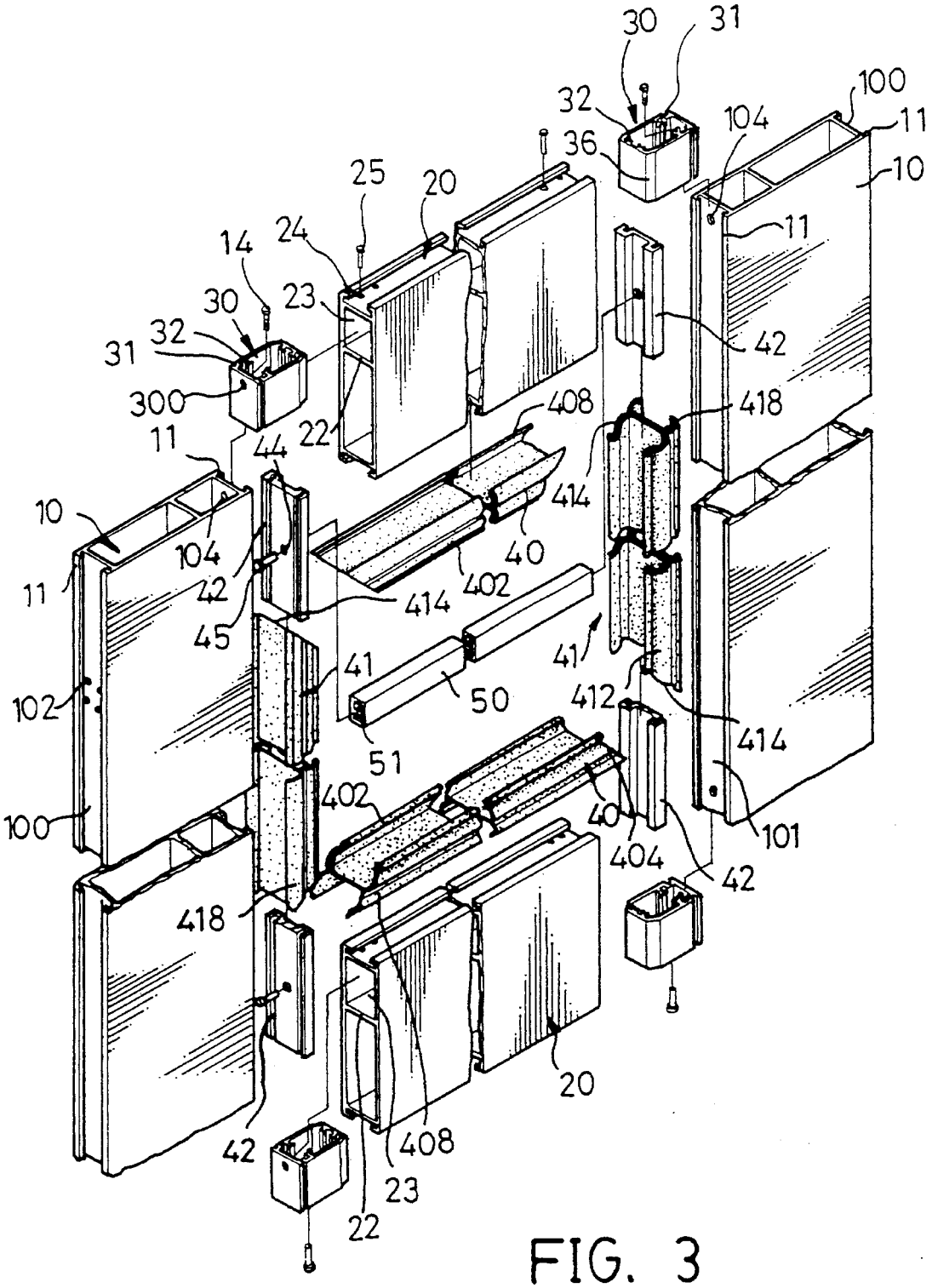
FIG. 3 is a partially exploded cross-sectional view of FIG. 2.
Figure 4:
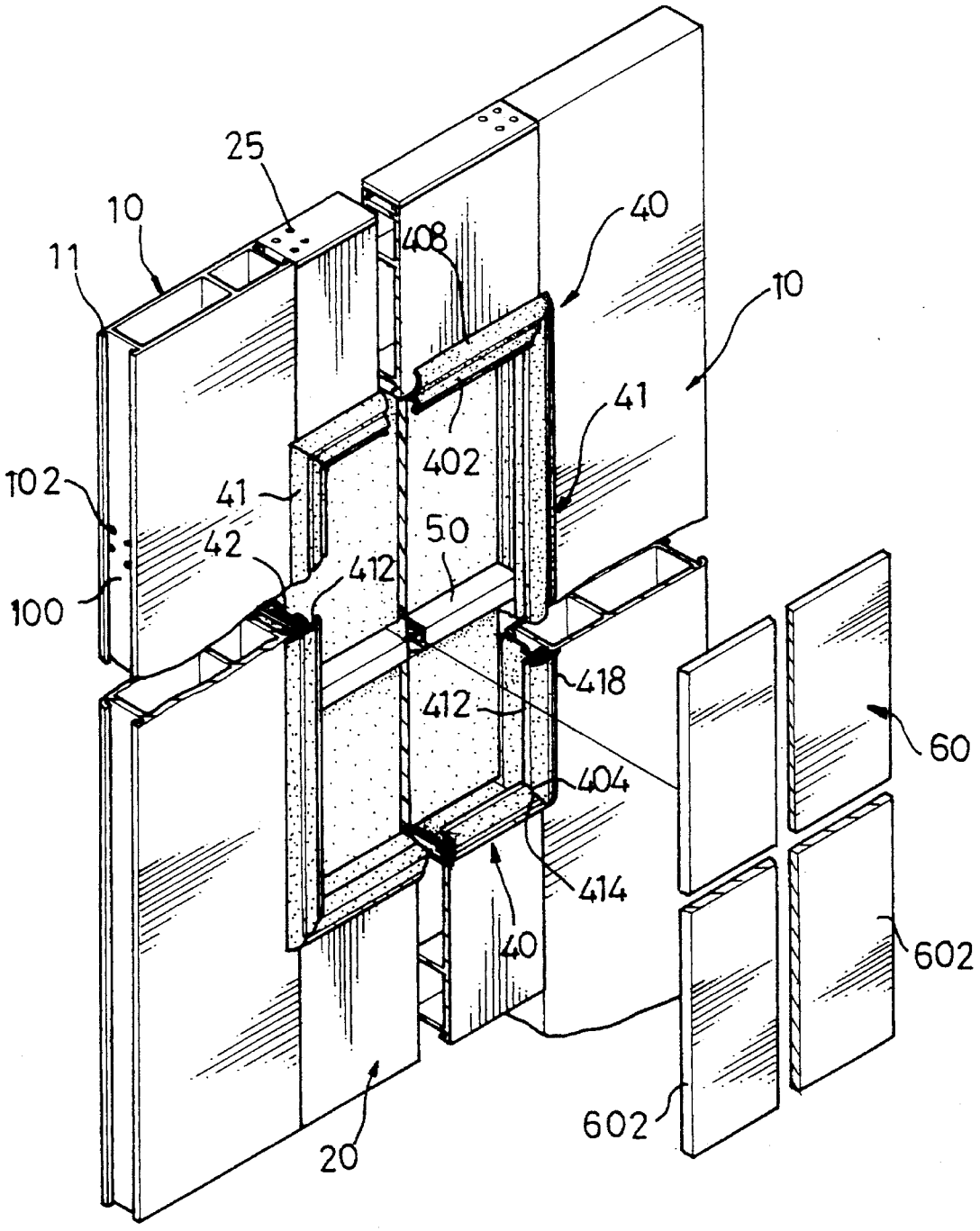
FIG. 4 is a perspective assembly view of FIG. 3.
Figure 5:
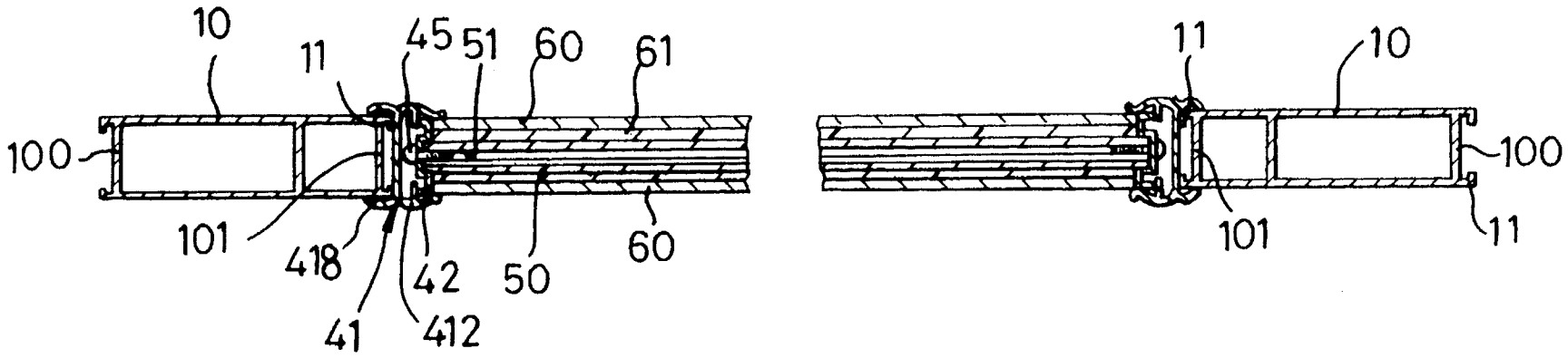
FIG. 5 is a top plan cross-sectional view of FIG. 4.

Referring to FIGS. 3–5 with reference to FIGS. 1 and 2, only two vertical side panels 10 and two horizontal side panels 20 are now taken into consideration for facilitating illustrations. Each of the vertical side panels 10 includes a first side wall 100 and a second side wall 101 each having two L-shaped flanges 11 formed thereon. Each of the two horizontal side panels 20 includes a partition 22 transversely formed therein, thereby defining a chamber 23 in two distal ends thereof.

There are four coupling members 30 each received in the chamber 23 of an associated distal end of one of the two horizontal side panels 20 and each fixedly engaged with an associated vertical side panel 10.

Preferably, each of the four coupling members 30 has a tapered end portion 36 fittingly received in an associated chamber 23. In addition, at least one positioning bolt 25 extends through an associated threaded hole 24 vertically defined in the two distal ends of each of the two horizontal side panels 20 and through a threaded channel 32 vertically defined in each of the four coupling members 30, thereby positioning each of the coupling members 30 in the associated distal end of each of the two horizontal side panels 20.

Further, each of the coupling members 30 has two grooves 31 vertically defined therein for receiving an associated L-shaped flange 11 of the second side wall 101 of each of the two vertical side panels 10 therein. A positioning bolt 14 extends through a threaded hole 300 defined in each of the coupling members 30 and through an associated threaded bore 104 defined in upper and lower ends of the second side wall 101 of each of the two vertical side panels 10, thereby fixedly fitting each of the coupling members 30 on an associated vertical side panels 10.

Two horizontal retaining members 40 each include a substantially U-shaped first outer snapping portion 408 mounted on a corresponding one of the two horizontal side panels 20 and a substantially U-shaped first inner snapping portion 402. Two vertical retaining members 41 each include a substantially U-shaped second outer snapping portion 418 mounted on a corresponding one of the two vertical side panels 10 and a substantially U-shaped second inner snapping portion 412.

Preferably, each of the horizontal and vertical retaining members 40 and 41 is cut in an oblique manner at two distal ends thereof, thereby forming two inclined portions 404 and 414 respectively.

Two vertical holding members 42 are each fitted in a corresponding one of the two second inner snapping portions 412.

Two central panels 60 are each located between the two horizontal retaining members 40 and fitted in the two first inner snapping portions 402, and are each located between the two vertical retaining members 41 and fitted in the two second inner snapping portions 412. Preferably, each of the two central panels 60 has two sides 602 each rested on one of the two holding members 42.

A horizontal reinforced beam 50 is fixedly mounted between the two holding members 42 and is rested between the two central panels 60. A positioning bolt 45 extends through a threaded hole 44 defined in each of the two holding members 42, and through a threaded panel 51 defined in each of two distal ends of the reinforced beam 50, thereby fixing the reinforced beam 50 between the two holding members 42. Preferably, two sound proof or noise suppression panels 61 are respectively mounted between the two central panels 60 and are rested on the reinforced beam 50 as shown in FIG. 5.

Figure 6:
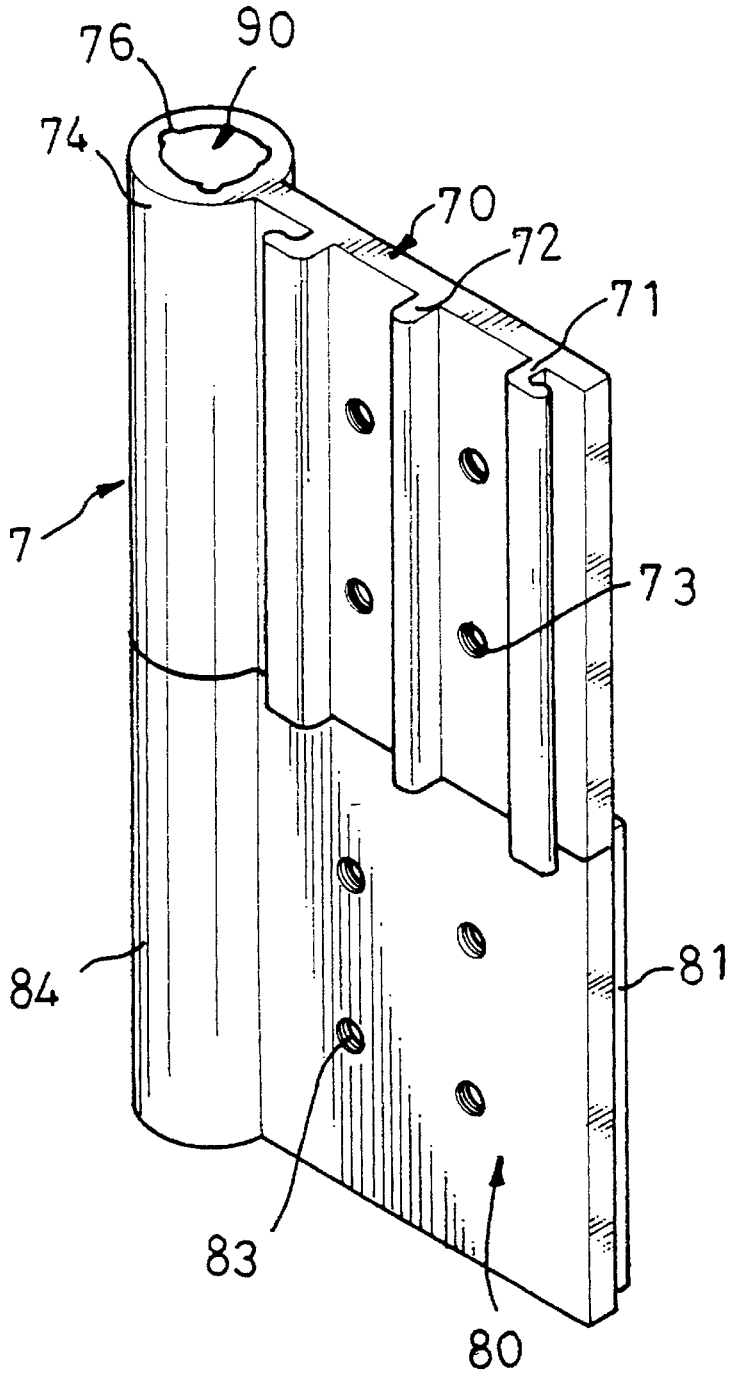
FIG. 6 is a perspective view of a hinge member in accordance with the present invention.
Figure 7:
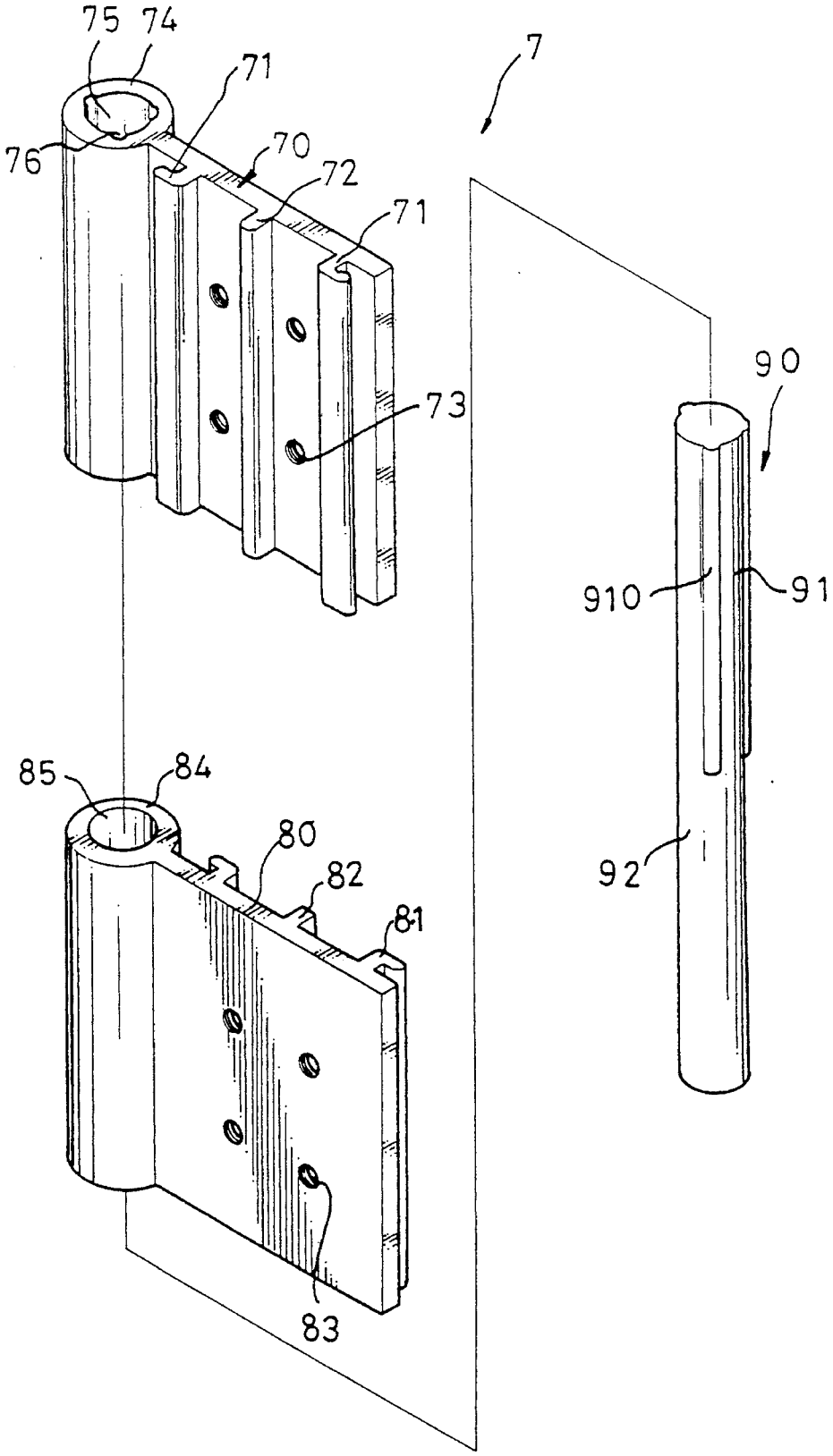
FIG. 7 is an exploded view of FIG. 6.
Figure 8:
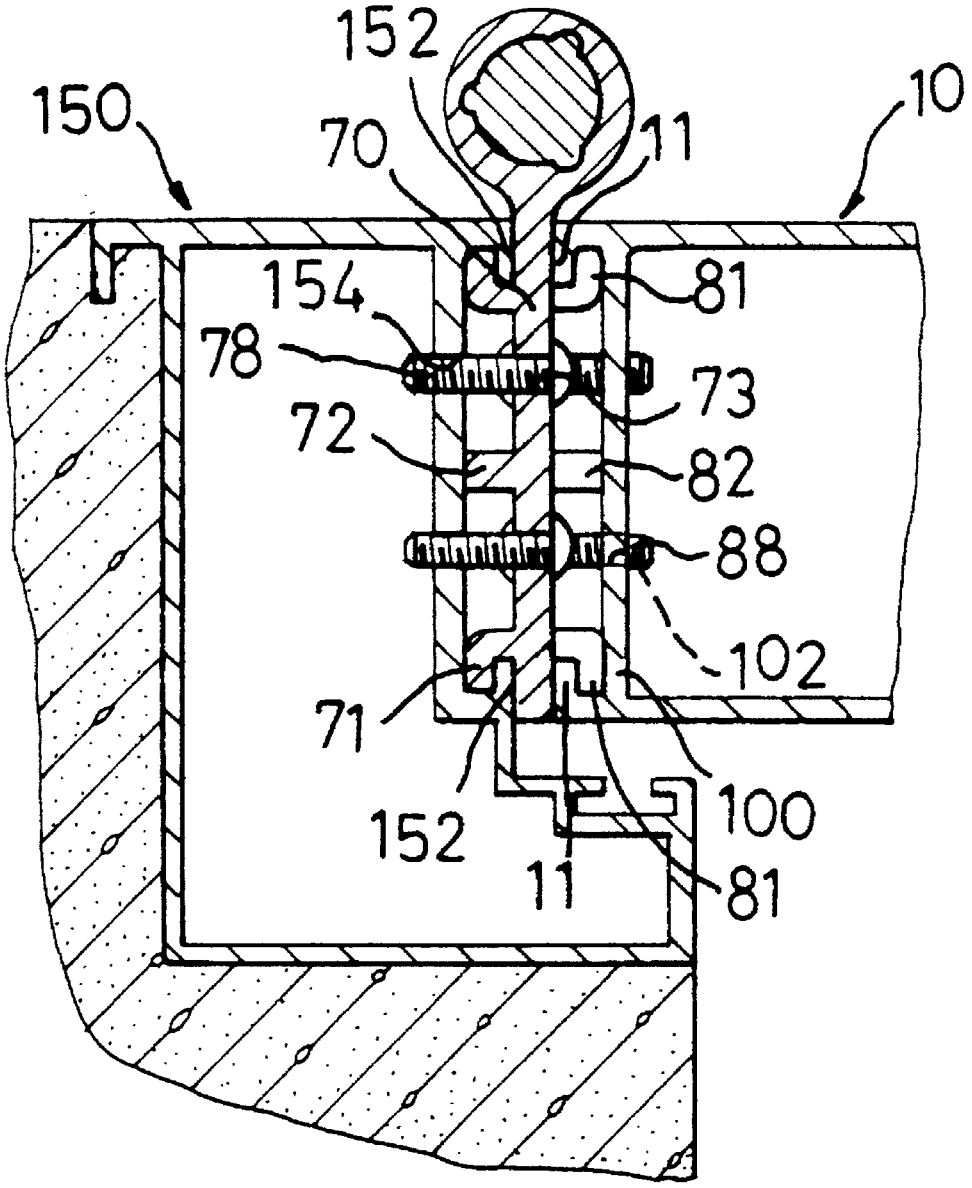
FIG. 8 is a top plan cross-sectional view of FIG. 7 showing the hinge member engaged with a vertical panel and a mounting frame.

Referring to FIGS. 6–8 with reference to FIGS. 1 and 2, each of the two first leaves 70 includes a first sleeve 74 formed thereon, a first passage 75 vertically defined in an inner wall of the first sleeve 74, and three depressions 76 each vertically defined in the inner wall of the first sleeve 74 and communicating with the first passage 75.

Each of the two second leaves 80 includes a second sleeve 84 formed thereon, and a second passage 85 vertically defined in the second sleeve 84 and aligning with the first passage 75. A pivot axle 90 includes a lower end portion 92 extending through the second passage 85 and an upper end portion 91 extending through the first passage 75. Three ribs 910 are each vertically formed on the upper end portion 91 of the pivot axle 90 and are each received in and limited by an associated depression 76.

Two L-shaped flanges 71 are each formed on each of the two first leaves 70 and are each engaged with one of two L-shaped flanges 152 formed on one side plate 150 of the mounting frame 15. A resting portion 72 is formed on each the first leaves 70 and abuts on the side plate 150. Four positioning bolts 78 each extend through a corresponding threaded hole 73 defined in the first leaf 70, and through an associated threaded bore 154 defined in the side plate 150, thereby fixing the first leaf 70 to the side plate 150.

Two L-shaped flanges 81 are each formed on each of the two second leaves 80 and are each engaged with an associated L-shaped flange 11 of the vertical side panel 10. A resting portion 82 is formed on each of the second leaves 80 and abuts on the side wall 100 of the vertical side panel 10. There are four positioning bolts 88 each extending through a corresponding threaded hole 83 defined in the second leaf 80, and through an associated threaded bore 102 defined in the side wall 100 of the vertical side panel 10, thereby fixing the second leaf 80 to the side wall 102 of the vertical panel side panel 10.

It should be clear to those skilled in the art that further embodiments of the present invention may be made without departing from the scope and spirit of the present invention.

What is claimed is:

1. A door structure comprising:

a substantially inverted U-shaped mounting frame (15) including two side plates (150);

at least one hinge member (7) including a first leaf (70) fixedly mounted on one of said two side plates (150), and a second leaf (80) pivotally engaged with said first leaf (70); and a panel module (1) pivotally mounted in said mounting frame (15) and comprising:

at least two vertical side panels (10) on one of which said second leaf (80) is fixedly mounted;

at least two horizontal side panels (20) each fixedly mounted between said two vertical side panels (10) and each including a partition (22) transversely formed in an innerside thereof and defining a chamber (23) in two distal ends thereof;

at least two pairs of coupling members (30) each received in said chamber (23) of an associated distal end of one of said two horizontal side panels (20) and each fixedly engaged with an associated vertical side panel (10);

at least two horizontal retaining members (40) each including a substantially U-shaped first outer snapping portion (408) mounted on a corresponding one of said two horizontal side panels (20) and a substantially U-shaped first inner snapping portion (402);

at least two vertical retaining members (41) each including a substantially U-shaped second outer snapping portion (418) mounted on a corresponding one of said two vertical side panels (10) and a substantially U-shaped second inner snapping portion (412);

at least two vertical holding members (42) each fitted in a corresponding one of said two second inner snapping portions (412);

at least two central panels (60) each located between said two horizontal retaining members (40) and fitted in said two first inner snapping portions (402), and each located between said two vertical retaining members (41) and fitted in said two second inner snapping portions (412); and at least one horizontal reinforced beam (50) fixedly mounted between said two holding members (42) and rested between said two central panels (60).

2. The door structure in accordance with claim 1, wherein each of said coupling members (30) has a threaded hole (300) defined therein and aligning with an associated threaded bore (104) defined in each of said vertical side panels (10), a positioning bolt (14) extending through each of said threaded holes (300) and an associated threaded bore (104), thereby fixedly fitting each of said coupling members (30) to an associated vertical side panel (10).

3. The door structure in accordance with claim 1, wherein said first leaf (70) includes a first sleeve (74) formed thereon, a first passage (75) vertically defined in an inner wall of said first sleeve (74), at least one depression (76) vertically defined in the inner wall of said first sleeve (74) and communicating with said first passage (75), said second leaf (80) including a second sleeve (84) formed thereon, a second passage (85) vertically defined in said second sleeve (84) and aligning with said first passage (75), a pivot axle (90) including a lower end portion (92) extending through said second passage (85) and an upper end portion (91) extending through said first passage (75), and at least one rib (910) vertically formed on the upper end portion (91) of said pivot axle (90) and received in and limited by said depression (76).

* * * * *